US005184918A

United States Patent [19]

Herrenknecht et al.

[11] Patent Number: 5,184,918

[45] Date of Patent: Feb. 9, 1993

[54] RECOVERABLE TUNNELLING MACHINE

[75] Inventors: Martin Herrenknecht, Schwanau; Werner Suhm, Gengenbach; Rainer Griesbaum, Meissenheim, all of Fed. Rep. of Germany

[73] Assignee: Herrenknecht GmbH, Schwanau, Fed. Rep. of Germany

[21] Appl. No.: 764,545

[22] Filed: Sep. 24, 1991

[30] Foreign Application Priority Data

Feb. 25, 1991 [CH] Switzerland ..... 564/91

[51] Int. Cl.[5] ..... E21D 9/06

[52] U.S. Cl. ..... 405/138; 405/141

[58] Field of Search ..... 405/138, 141, 143, 146, 405/154, 184; 299/31, 33

[56] References Cited

U.S. PATENT DOCUMENTS

| | | | |
|---|---|---|---|
| 3,967,463 | 7/1976 | Grandori | 405/141 |
| 4,571,122 | 2/1986 | Yamamoto et al. | 405/184 |
| 4,655,493 | 4/1987 | Sumi | 299/33 |
| 4,804,295 | 2/1989 | Kondo | 405/141 |
| 4,886,396 | 12/1989 | Akesaka | 405/184 |

*Primary Examiner*—David H. Corbin

*Attorney, Agent, or Firm*—Ralph W. Selitto, Jr.

[57] ABSTRACT

The tunnelling machine for driving inaccessible tunnels by pressing forward by means of tubes can be moved out again through the tunnel driven by it. For this purpose, an annular outer area (2*b*) is provided on the extracting tool (2), and one double casing (4*b*, 6*b*) each is provided around the control head (4) and the machine tube (6). The outer area (2*b*) of the extracting tool is connected to its inner area (2*a*) and the control-head double casing (4*b*) is connected to the control-head housing (4*a*) by connecting elements (24, 26). Specifically releasable restraining devices (28) hold the machine-tube double casing (6*b*) on the machine-tube housing (6*a*). After the final depth is reached, the control head (4) can be moved back by means of the control devices (40) to such an extent towards the machine tube (6) that the connecting elements (24, 26) are broken. If the restraining devices (28) are then released, the tunnelling machine is separated from the extracting-tool outer area (2*b*) and the double casings (4*b*, 6*b*) and can be withdrawn at withdrawal means (42) provided for this purpose, whereby the tunnelling machine may be recovered for reuse in a simple manner even from tunnels which do not end in a target shaft.

16 Claims, 3 Drawing Sheets

Figure 1:
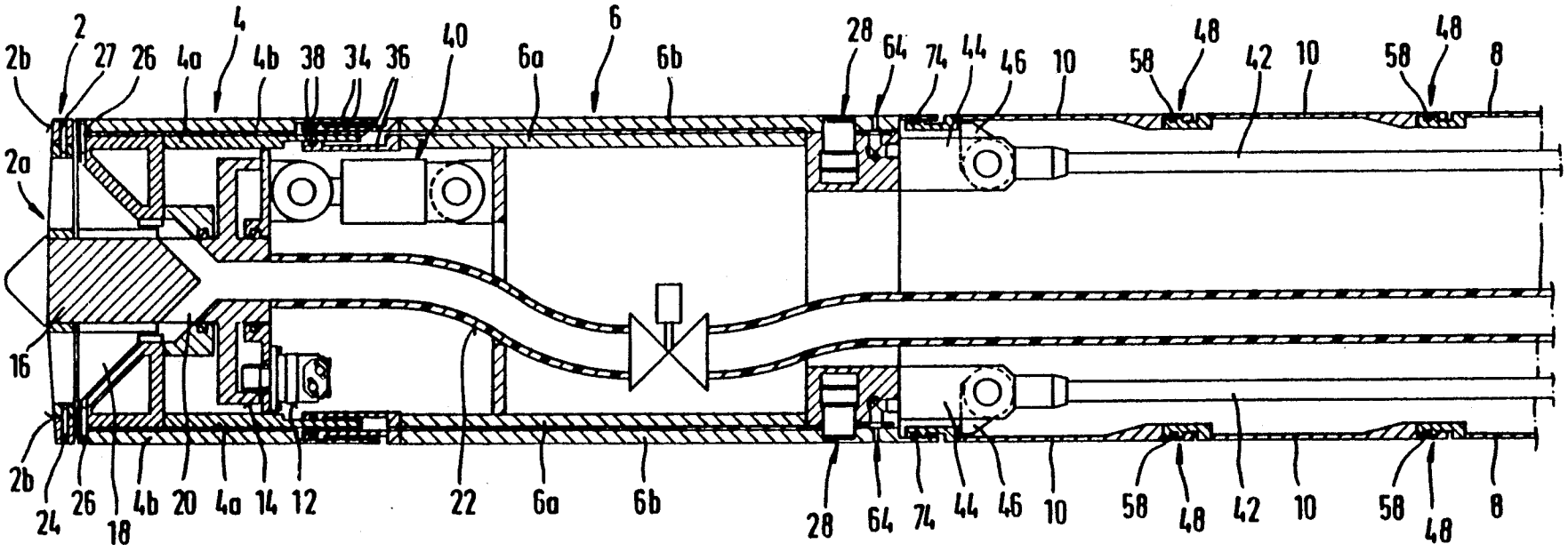

RECOVERABLE TUNNELLING MACHINE invention relates to a controllable tunnelling machine for driving tunnels by pressing forward via product tubes, in particular for inaccessible tunnel cross-sections, according to the preamble of independent Patent Claim 1, as well as to a method of operating it.

Boreholes or tunnels having a so-called inaccessible tunnel cross-section, that is, having a tunnel diameter of about 10 to 160 centimeters, are conveniently produced by tunnelling machines which can be controlled from a fixed control station. Tunnelling machines of this type are pressed forward into the ground from the rear, initially directly and, as the tunnel length advances, via press or product tubes pushed in gradually and firmly connected, for example welded, to one another. In the process, the ground is excavated at the tip of the tunnelling machine by an excavating tool, for example a cutting wheel or a scraper disc, and the excavated material is conveyed away through the developing tunnel by a conveying device.

So that the valuable tunnelling machine can be recovered and reused after completion of the tunnel, the tunnels are always constructed in a conventional manner in such a way that they end in a target shaft into which the tunnelling machine can be moved out. This is necessary because tunnelling machines for driving tunnels by pressing forward by means of tubes for inaccessible tunnel cross-sections according to the prior art cannot be moved back.

However, it is obvious that, in a considerable number of applications, the production of a target shaft is expensive, is not convenient or is even impossible. This applies, for example, to auxiliary galleries for freezing large tunnel profiles during conventional advance, to complex gallery systems, as used, for example, for waste deposits, or also for galleries which have to be driven beneath existing installations, such as railroad lines or buildings, which completely prohibit the construction of a target shaft.

A further problem arises if an obstacle through which the tunnelling machine cannot pass is struck during the tunnel advance, or if a machine defect occurs. In these cases, it would be advantageous to be able to withdraw not only the tunnelling machine but with it the entire tube line.

The main object of the invention is therefore to propose a tunnelling machine of the type described at the beginning which can be moved out again in a simple manner through the tunnel driven by it.

The achievement of this object according to the invention is defined in the characterizing part of independent Patent Claim 1. Developments of the invention are the subject matter of the dependent claims.

A main idea behind the invention is to divide the tunnelling machine into a peripheral area which is easy and inexpensive to replace and into an inner area containing all essential machine parts in such a way that, after the final depth of a tunnel is reached, the parts of the inner area can be separated from those of the peripheral area and can be moved out again through the tube section. For this purpose, the extracting tool is provided with an outer ring, and both the control head and the machine tube of the tunnelling machine are surrounded by a double casing. During the advance, the machine-tube double casing is held in place on the machine by restraining devices which can subsequently be specifically released, and the control-head double casing is held in place on the machine by connecting elements, and the outer ring of the extracting tool is also firmly connected to its inner area by connecting elements. If the tunnelling machine is now to be moved out again, first the control head is moved back toward the machine tube by means of the appropriately designed control devices. In the course of this return movement, the control-head double casing strikes the machine-tube double casing as a result, so that, by still further return movement, the connecting elements of control-head double casing and extracting tool are broken. The mutual support, required for this operation, of control device or machine tube and machine-tube double casing is achieved by the restraining devices. The restraining devices are then released, and the tunnelling machine can be withdrawn out of the double casings and through the tunnel tubes by specifically provided withdrawal means, for example drawbars. Only the outer ring of the extracting tool and the double casings are left behind in the tunnel, the outer ring and the double casings at the same time forming the front end of the tube section in an advantageous manner as desired. The entire tunnelling machine is therefore available again for the next use and need only be equipped again with double casing and outer ring of the extracting tool.

A further important idea behind an advantageous embodiment of the invention is to design the connection between tunnelling machine and tube line and also if need be between trailing tubes inserted between tunnelling machine and product tube in such a way that, in the event of defects or insurmountable obstacles, the entire tunnelling machine together with the entire tube line can be withdrawn by pulling on the rear end of the tube line. For this purpose, blocking members are attached to the rear end of the machine tube, which blocking members block a movement of the tunnelling machine relative to the tube line in the driving direction but permit the relative movement in the opposite direction. The tunnelling machine is thus pulled along during the withdrawal of the tube line, but conversely, during withdrawal of the tunnelling machine by the withdrawal means provided, the tube line is left in situ.

Figure 2:
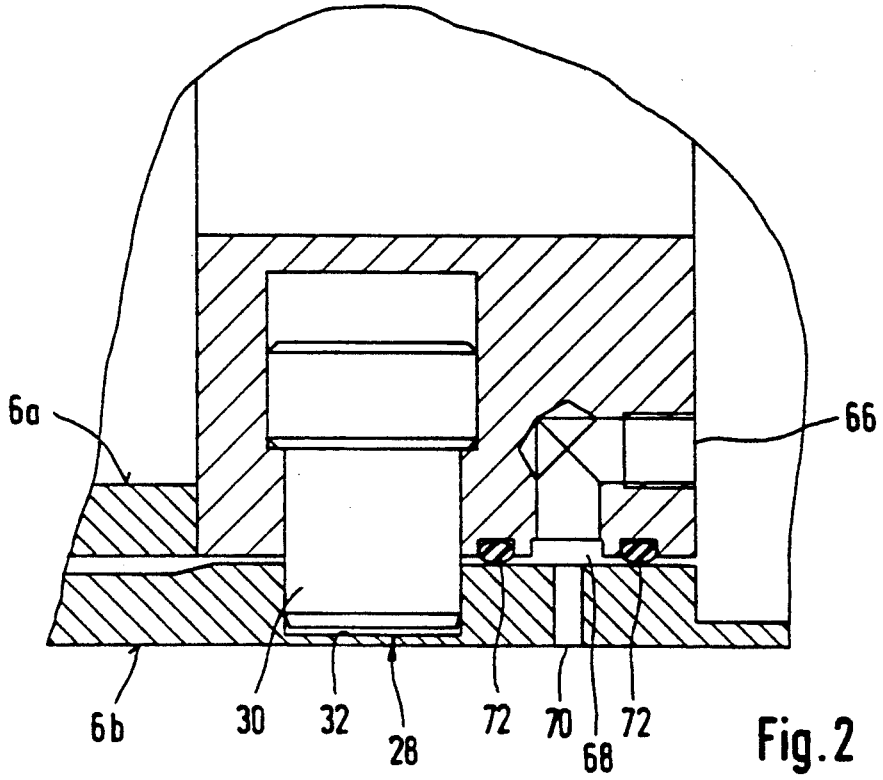
Figure 3:
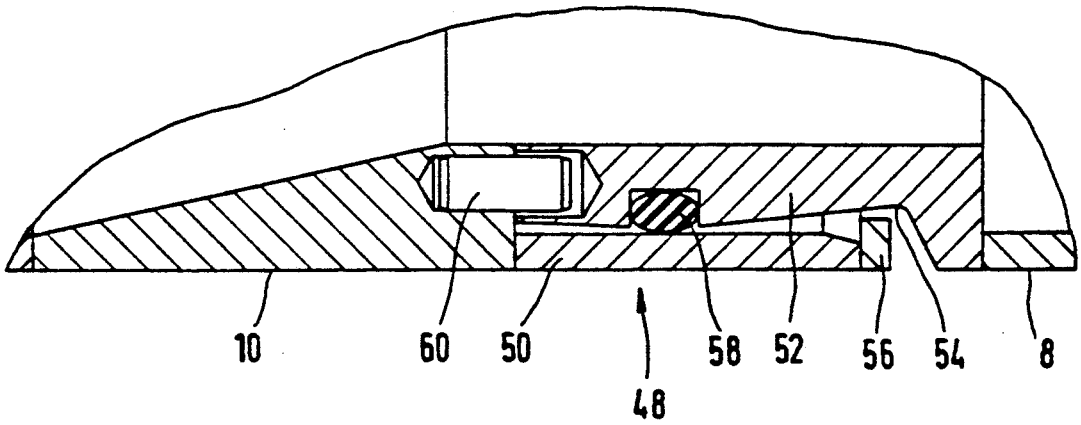
Figure 4:
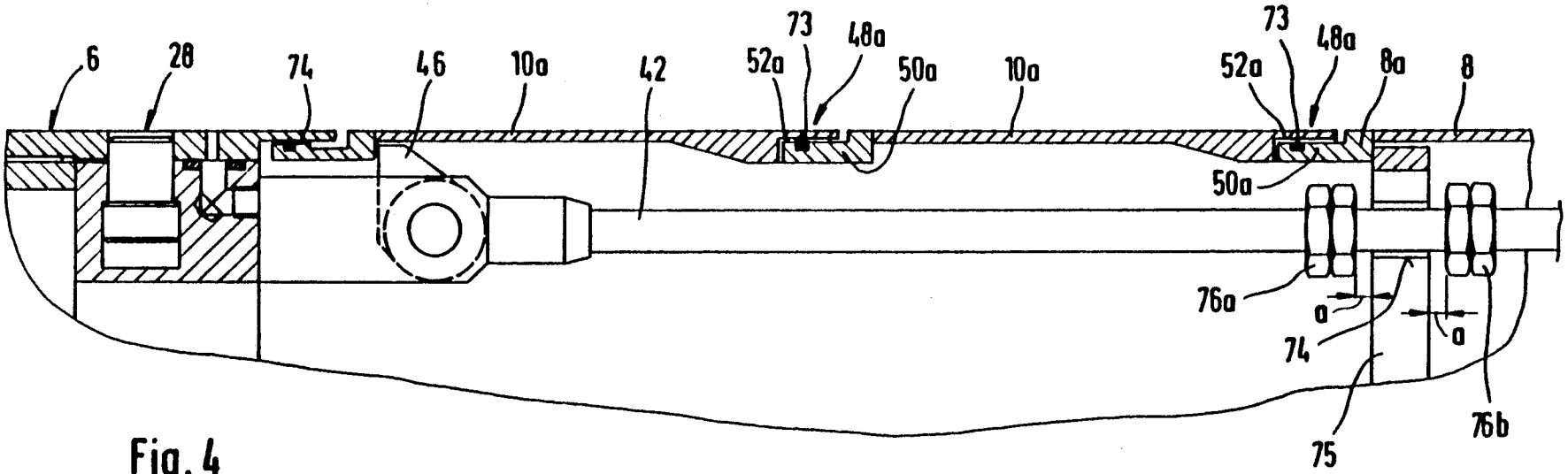

An exemplary embodiment of the invention is described below with reference to the associated drawings, in which:

FIG. 1 shows a sectional representation of a tunnelling machine according to the invention, together with two attached trailing tubes and a first product tube, FIG. 2 shows an enlarged detail from FIG. 1 with a restraining cylinder and passages for feeding a lubricant, FIG. 3 shows an enlarged detail from FIG. 1 in the area of the articulated connection of a trailing tube and a product tube, and FIG. 4 shows an embodiment variant with the aid of a partial section.

The tunnelling machine depicted in FIG. 1 can be roughly divided into the sections extracting tool 2, control head 4 and machine tube 6. The extracting tool lies at the front as viewed in the driving direction. Attached to the rear end of the tunnelling machine are product tubes 8 which support a driven tunnel and via which the tunnelling machine is pressed forward. In the preferred embodiment depicted, two trailing tubes 10 are inserted between tunnelling machine and first product tube, with which trailing tubes 10 the controllability of the entire apparatus can be improved. The trailing tubes 10 and the product tubes 8 gradually attached during the driving are designated below in their entirety as tube line.

The extracting tool 2 shown in the exemplary embodiment is a cutting disk which is rotated by a drive member 12 via a drive rim 14 and a shaft 16 and extracts the ground material at the front. The extracted ground material passes into the funnel-like area 18 and is conveyed away from there through openings 20 and a conveying line 22.

According to the invention, the extracting tool 2 is split into an inner area 2a and an outer ring 2b. Inner area and outer ring are rigidly connected by a number of shearing pins 24 distributed over the periphery and serving as first connecting elements. In a similar manner, the control head 4 and the machine tube 6 are also split into an inner and outer area by a control-head housing 4a being surrounded by a control-head double casing 4b and respectively by a machine-tube housing 6a being surrounded by a machine-tube double casing 6b. The control-head double casing 4b is likewise rigidly connected to the control-head housing 4a by a number of shearing pins 26 distributed over the periphery and serving as second connecting elements. The machine-tube double casing 6b is not held on the machine-tube housing 6a with shearing pins but, essential to the invention, with specifically releasable restraining devices 28.

A restraining device 28 can be seen enlarged in FIG. 2. In this arrangement, a restraining cylinder 30 displaceably guided in the machine-tube housing 6a engages in a corresponding bore 32 in the machine-tube double casing 6b. The restraining cylinder is hydraulically actuated and can thus be released again by remote control when required.

Control head 4 and machine tube 6 are connected to one another in an articulated manner. For this purpose, narrowed double-casing end areas 34 and respectively housing end areas 36 overlap one another at a distance. Toroidal sealing rings 38 are inserted between the overlapping end areas to provide a seal. The actual coupling between control head and machine tube is effected by three control presses 40, of which one can be seen in FIG. 1. These control presses, as a control device, serve on the one hand to control the driving of the tunnelling machine in a known manner by being able to selectively deflect the control head towards the machine tube. However, their additional function, essential within the scope of the present invention, is to shear off the shearing pins 24 and 26—in a manner still to be described in more detail—by moving the control head back towards the machine tube. The respective length of the above-mentioned overlapping double-casing or housing end areas 34 and 36 respectively is here selected in such a way that, when the control head is moved back, the control-head housing 4a can be moved back further than the control-head double casing 4b.

Inserted into the tube line are drawbars 42 which are connected to the tunnelling machine via plates 44 welded to the machine-tube housing 6a.

The construction described of a tunnelling machine enables the tunnelling machine to be moved out again through the tube line after the final depth of a tunnel is reached. For this purpose, first the control-head double casing 4b is brought to bear against the machine-tube double casing 6b by retracting the control presses 40. The inner area 2a of the extracting tool and the control-head housing 4a are then displaced to the rear relative to the outer ring 2b and the control-head double casing 4b by further retraction of the control presses 40, so that the shearing pins 24 and 26 are sheared off. During this operation, the machine-tube double casing 6b is supported on the machine-tube housing 6a by the restraining devices 28. After the shearing pins 24 and 26 are sheared off, the machine-tube double casing 6b can also be separated from the machine-tube housing 6a by releasing the restraining devices 28, whereupon the entire tunnelling machine, with the exception of the outer ring 2b and the double casings 4b and 6b, can be withdrawn at the drawbars 42. Alternatively, material, for example concrete, can here be pressed in through the conveying line 22 for sealing the face. The retraction function of the control presses is preferably locked by an appropriate circuit against unintentional actuation during the driving.

To permit a total withdrawal in the event of a defect or an insurmountable obstacle, that is, a withdrawal of the entire tunnelling machine and the entire tube line by pulling on the rear end of the tube line, further measures are taken in a preferred embodiment of the invention. Claws 46 are mounted on the plates 44 in such a way that they can be swung forward from the position shown in FIG. 1 and locked to the rear. The claws 46 are pressed by spring force from the inside either against the first product tube or, as in the exemplary embodiment depicted, against the first trailing tube. Together with a step provided for this purpose in the product or trailing tube, the claws 46 act as blocking members which block a displacement of the tunnelling machine in the driving direction relative to the tube line. Thus, in the event of total withdrawal, a tensile force is transmitted from the tube line via the blocking members to the entire tunnelling machine. On the other hand, if the tunnelling machine is withdrawn at the drawbars 42 after reaching the final depth, the claws 46 run free on the inside of the tubes and are if need be swung forward and to the inside by reductions in the inside diameter, for example in the area of articulated connections 48 between the two trailing tubes 10 or between the rear trailing tube and the first product tube 8. In their blocking position, the claws 46 are also preferably supported laterally on ribs provided for this purpose on the inner wall of the trailing or product tube in order to prevent the tunnelling machine from rolling relative to the tube line.

If a total withdrawal is also to be possible in exemplary embodiments of the invention having trailing tubes 10 inserted between first product tube and tunnelling machine, it must also be ensured for the above-mentioned articulated connections 48 that a tensile force can be transmitted. A first exemplary embodiment described here uses connections designed specifically for this purpose. One of these connections is shown enlarged in FIG. 3. Welded to the facing ends of trailing tube 10 and first product tube 8 are flange rings 50 and 52 respectively. The two flange rings overlap at a distance. On its inside, the outer flange ring 52 has a niche 54 into which a flange 56 welded to the inner flange ring 50 projects; the flange 56 abuts against the front wall of the niche 54 as soon as the product tube 8 is pulled to the rear and thereby transmits a tensile force applied from the rear to the front tube. A toroidal sealing ring 58 inserted to provide a seal and one of a plurality of dowel pins 60 distributed over the periphery can likewise be seen. Mutual rolling of the tubes connected in an articulated manner is advantageously prevented by the dowel pins 60. The connection between the two trailing tubes 10 is also designed in the same way as described above.

A further exemplary embodiment of such a type of connection which permits the total withdrawal in the case of inserted trailing tubes is shown in FIG. 4, in which the reference numerals already introduced have been retained for the parts which have remained unchanged. In contrast to the embodiment described with reference to FIGS. 1 to 3, although the articulated connections 48*a* of the trailing tubes designated here by 10*a* are again provided with flange rings 50*a* and 52*a* overlapping one another, the flange rings 50*a* and 52*a* merely lie flat one upon the other with a seal 73 in between. A positive-locking connection is therefore not obtained in the overlapping area of the two flange rings 50*a* and 52*a* and thus no appreciable tensile force can be transmitted in this area in the axial direction by the articulated connections 48*a*.

So that the total withdrawal of driving machine and tube line can now also be permitted in this embodiment shown in FIG. 4, a carrier plate 75 provided with bores 74 is pushed onto the drawbars 42, the position of which carrier plate 75 on the drawbars 42 is determined by double nuts 76*a* and 76*b* (nuts and lock-nuts) screwed firmly on either side onto the drawbars. If an axial tensile force is now exerted on the product tube 8, this tensile force is transmitted from the driving shoulder (designated by 8*a*) of the product tube to the carrier plate 75. The latter hits the double nut 76*b* after a slight axial displacement, which is absorbed in the articulated connections 48*a*. Thus the tensile force is transmitted to the drawbars 42 and the total withdrawal is permitted without the articulated connections 48*a* being subjected to axial tensile stress.

During the total withdrawal, the withdrawal force introduced via the product tubes 8 is transmitted via the drawbars 42 to the tunnelling machine, which then pushes the trailing tubes 10*a* ahead of it during the withdrawal after the compensation for play in the overlapping area of the articulated connections.

According to FIG. 4, the two double nuts 76*a* and 76*b* are arranged at a distance a from the carrier plate 75 in order to also permit the curve-negotiating characteristic of the system.

So that no subsidence of the ground can occur in the course of a total withdrawal, a filling material, for example concrete, can be poured into the borehole through the conveying line 22 during the withdrawal.

In particular when driving longer tunnels, it is of advantage to reduce the skin friction of the tube line on the borehole wall with a lubricant, for example bentonite, so that the requisite pressure forces for the driving do not become too great. In a further embodiment, therefore, passages 64 are provided in the machine-tube housing 6*a* and in the machine-tube double casing 6*b*, through which passages 64 the lubricant can be poured between double casing and borehole wall (cf. FIG. 2). An angled bore 66 in the machine-tube housing 6*a*, onto which bore 66 a feed hose (not shown) can be mounted, leads into an annular groove 68. There are a number of continuous bores 70, distributed over the periphery, in the machine-tube double casing 6*b* opposite the annular groove. The lubricant fed in through the bore 66 is distributed in the annular groove 68 and discharged through the bores 70. Penetration of lubricant into the space between housing and double casing is prevented by sealing rings 72.

Finally, it should be specifically mentioned that the embodiments shown and described merely represent examples which can be modified in various ways by the person skilled in the art within the scope of the idea behind the invention defined in the independent patent claim. Thus the restraining devices of machine tube and machine-tube double casing, for example, could not only be realized as hydraulically actuated restraining cylinders but also in other forms known to the person skilled in the art, and also the breakable connecting elements are not only conceivable as shearing pins but also, for example, as appropriately dimensioned welds. Likewise, the withdrawal means could be designed not only as drawbars but also, for example, as ropes or chains.

We claim:

1. Controllable tunnelling machine for driving tunnels, in particular, for inaccessible tunnel cross-sections, by pressing forward via product tubes having an inside diameter and an outside diameter, comprising a machine tube, a control head connected to the machine tube in an articulated manner, control devices for deflecting the control head relative to the machine tube, and an extracting tool on the control head, the extracting tool being divided into an inner area, having an outside diameter which is at most as large as the inside diameter of the product tubes, and an annular outer area connected to the inner area by first connecting elements, the control head including a control-head housing, having an inside diameter and an outside diameter, and a control-head double casing surrounding the control-head housing and having an inside diameter and an outside diameter, the machine tube having a machine-tube housing, having an inside diameter and an outside diameter, and a machine-tube double casing surrounding the machine-tube housing and having an inside diameter and an outside diameter, the inside diameter and outside diameter of both the control-head double casing and the machine-tube double casing matching the inside diameter and the outside diameter, respectively, of the product tubes, the outside diameter of the control-head housing and the outside diameter of the machine-tube housing being at most as large as the inside diameter of the product tubes, the control-head double casing being connected to the control-head housing by second connecting elements, the machine-tube double casing being attached to the machine-tube housing by releasable restraining devices, the control head being movable by means of the control devices towards the machine tube such that the control-head double casing contacts the machine-tube double casing, while restraining devices hold the machine-tube double casing in place on the machine-tube housing, and such that the first and second connecting elements can be broken, and the machine tube housing including withdrawal means insertable into a tube line formed by the product tubes for withdrawing the tunnelling machine through the tube line after the restraining devices are released.

2. Tunnelling machine according to claim 1, wherein the machine tube has at its rear end area blocking members for blocking movement of the tunnelling machine relative to the tube line in the driving direction, the blocking members permitting the relative movement of the tunnelling machine in the opposite direction in such a way that, on the one hand, during withdrawal of the tube line, the entire tunnelling machine can also be pulled along, and, on the other hand, withdrawal of the tunnelling machine through the tube line is not impaired.

3. Tunnelling machine according to claim 1 or 2, wherein at least one trailing tube is inserted between the machine tube and a foremost product tube for the purpose of improving controllability, the trailing tube being connected in an articulated manner to both the machine-tube double casing and the foremost product tube.

4. Tunnelling machine according to claim 3, wherein two or more trailing tubes are inserted between the machine tube and the foremost product tube, the two or more trailing tubes being connected to one another in an articulated manner.

5. Tunnelling machine according to claim 4, wherein the product tube and the trailing tubes are connected to one another in an articulated manner in such a way that the trailing tubes can also be pulled along during withdrawal at a rear end of a tube section.

6. Tunnelling machine according to claim 5, wherein the withdrawal force exerted on the tube section at the rear end thereof is transmitted by way of a carrier element from one of the product tubes to the withdrawal means and from the withdrawal means to the tunnelling machine so that no tensile stress is exerted on the trailing tubes during withdrawal of the tube section.

7. Tunnelling machine according to claim 6, wherein the carrier element is a carrier plate attached to the withdrawing means with a peripheral edge adjacent to a driving shoulder of the product tube, the position of the carrier plate on the withdrawing means being secured by double nuts.

8. Tunnelling machine according to claim 7, wherein the double nuts are arranged on the withdrawing means at a distance from the carrier plate in order to ensure the curve-negotiating characteristic of the tube section.

9. Tunnelling machine according to claim 1 or 2, wherein the machine tube and a foremost product tube are secured against mutual rolling relative to the tunnel axis.

10. Tunnelling machine according to claim 5, wherein the machine tube, the product tube, and the trailing tubes are secured to one another to prevent mutual rolling relative to the tunnel axis.

11. Tunnelling machine according to claim 1, further comprising sealing elements for sealing the tunnelling machine against the ingress of ground water.

12. Tunnelling machine according to claim 1, wherein the control devices are two or more hydraulically driven control presses.

13. Tunnelling machine according to claim 1, wherein the machine-tube housing and the machine-tube double casing include passages through which a lubricant can be poured.

14. Method of operating the tunnelling machine according to claim 1, characterized in that, after the final depth is reached, the outer area of the extracting tool, the control-head double casing and the machine-tube double casing are separated from the rest of the tunnelling machine by first the control head being moved back by means of the control devices towards the machine tube until the first and second connecting elements are broken after the control-head double casing strikes the machine-tube double casing supported on the machine-tube housing by the restraining devices, and then by the restraining devices being released, whereupon the tunnelling machine is withdrawn through the tube line at the withdrawal means.

15. Method of operating the tunnelling machine according to claim 1, characterized in that, if defects or insurmountable obstacles appear, the entire tube line and the entire tunnelling machine are moved out by pulling on a rear end of the tube line.

16. Method according to claim 15, characterized in that a borehole space exposed in front of the tunnelling machine during the driving is continuously filled with a filler material which is introduced through a conveying line.

* * * * *